US010508354B2

(12) United States Patent
Fujikata

(10) Patent No.: US 10,508,354 B2
(45) Date of Patent: Dec. 17, 2019

(54) FEEDER CAPABLE OF FEEDING ANODE AND PLATING APPARATUS

(71) Applicant: EBARA CORPORATION, Tokyo (JP)

(72) Inventor: Jumpei Fujikata, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 34 days.

(21) Appl. No.: 15/618,879

(22) Filed: Jun. 9, 2017

(65) Prior Publication Data

US 2017/0356098 A1 Dec. 14, 2017

(30) Foreign Application Priority Data

Jun. 10, 2016 (JP) ..... 2016-116136

(51) Int. Cl.
*C25D 17/00* (2006.01)
*C25D 17/10* (2006.01)
*C25D 17/12* (2006.01)

(52) U.S. Cl.
CPC ..... *C25D 17/007* (2013.01); *C25D 17/001* (2013.01); *C25D 17/005* (2013.01); *C25D 17/10* (2013.01); *C25D 17/12* (2013.01)

(58) Field of Classification Search
CPC .... C25D 17/007; C25D 17/10; C25D 17/001; C25D 17/005; H01L 21/2885
See application file for complete search history.

(56) References Cited

U.S. PATENT DOCUMENTS 2,482,374 A * 9/1949 Ruschmeyer ..... B07B 1/48 157/1.21
4,819,307 A * 4/1989 Turner ..... F16L 33/04 24/20 S
8,177,944 B2 * 5/2012 Saito ..... C25D 21/10 204/230.2
2009/0050473 A1 * 2/2009 Yahagi ..... C25D 17/12 204/288.6
2012/0061246 A1 * 3/2012 Feng ..... C25D 17/001 205/157
2012/0205249 A1 * 8/2012 Inoue ..... C25D 3/44 205/143

FOREIGN PATENT DOCUMENTS

JP 4942580 B2 5/2012

* cited by examiner

*Primary Examiner* — Louis J Rufo
(74) *Attorney, Agent, or Firm* — Baker & Hostetler LLP

(57) ABSTRACT

There is provided a feeder capable of reducing deterioration of the contact state between the feeder and an anode more than the prior art as dissolution of the anode progresses. The feeder can supply power to the anode 5 for use in plating a substrate in a plating tank. The feeder includes a main body portion 1 which can be disposed on an outer periphery of the anode 5 and a spring 88 which is disposed in the main body portion 1 and can apply a first force 100 to the main body portion 1 in a direction from the main body portion 1 toward a region 80 surrounded by the main body portion 1.

4 Claims, 19 Drawing Sheets

FEEDER CAPABLE OF FEEDING ANODE AND PLATING APPARATUS

CROSS REFERENCE TO RELATED APPLICATIONS

This application is based upon and claims benefit of priority from Japanese Patent Application No. 2016-116136 filed on Jun. 10, 2016, the entire contents of which are incorporated herein by reference.

BACKGROUND OF THE INVENTION

Field of the Invention

The present invention relates to a plating apparatus, and more particularly to a feeder such as a feeding band capable of feeding an anode for use in performing a plating process on a surface of a substrate such as a semiconductor wafer.

Description of the Related Art

Recent years have seen the use of a method of forming wirings and bumps on a semiconductor circuit and more specifically a method of forming metal films and organic membranes on a substrate such as a semiconductor wafer by performing a plating process. For example, wirings and bumps (protruding connecting electrodes) made of gold, silver, copper, solder, nickel, or a combination thereof are formed in multiple layers at a predetermined position on the surface of a semiconductor wafer having semiconductor circuits or fine wirings formed to interconnect semiconductor circuits. Then, the semiconductor circuits and the like are connected to package substrate electrodes or tape automated bonding (TAB) electrodes via the bumps. Examples of the method of forming wirings and bumps include electroplating, electroless plating, vapor deposition, and printing. With an increased number of I/O terminals and finer pitches in a semiconductor chip, an electroplating method (for example, see Japanese Patent No. 4942580) enabling microfabrication and high-speed film deposition has been frequently used. The metal film obtained by a currently frequently used electroplating has advantages of high purity, high-speed film formation, and simple film thickness control.

The increasing demand for microfabrication of wirings formed on a substrate has required a higher level of stability of feeding an anode than before.

FIG. 18 is a schematic view illustrating a prior art of a so-called vertical immersion plating apparatus in which a substrate and an anode are vertically disposed. This plating apparatus includes a plating tank 34 containing a plating solution Q1 therein, in which an anode 5 held by an anode holder 156 is placed facing a substrate WF held by a substrate holder 18 so that both surfaces are arranged in parallel. A current is passed between the anode 5 and the substrate WF through a plating power supply 105, thereby to perform electroplating on a to-be-plated surface W1 of the substrate WF exposed from the substrate holder 18. Note that the plating tank 34 further includes a plating solution supply port 111, a plating solution discharge port 112, and a plating solution circulation means 106. The plating solution circulation means 106 supplies the plating solution Q1 into the plating tank 34 through the plating solution supply port 111 and discharges the plating solution Q1 through the plating solution discharge port 112 to be circulated.

The method of feeding the anode 5 includes a method by contacting a feeding band to an outer periphery of the anode

5. More specifically, the anode 5 is attached to the anode holder 156 so that the feeding band is in contact with the outer periphery of the anode 5. Then, the anode holder 156 having the anode 5 with the band attached thereto is placed facing the substrate in the plating solution. At plating, current is supplied to the anode 5 via the band (see Japanese Patent No. 4942580).

The anode 5 is divided into a soluble anode that dissolves by plating current and an insoluble anode that does not dissolve by plating current. During plating process, as metal ions in the plating solution deposit on an object to be plated, the metal ion concentration in the plating solution is reduced. Continuous plating needs to continuously replenish the plating solution with metal ions whose concentration is reduced. Therefore, in general, the plating apparatus using an insoluble anode needs to continuously replenish the plating solution with plating metal ions by a method other than anode dissolution, and is accordingly costlier than the plating apparatus using a soluble anode. Thus, the plating apparatus using a soluble anode has been more popular. However, it has been found that the method of performing electroplating on a soluble anode held by the anode holder 156 disclosed in Japanese Patent No. 4942580 involves the following problems. More specifically, as plating progresses, the thickness of the soluble anode is reduced and at the same time the outer peripheral portion of the anode 5 also dissolve. Then, the diameter of the anode 5 is reduced and the contact state between the band and the anode 5 deteriorates. It has been found that as illustrated in FIG. 19, when the contact state between the band and the anode 5 deteriorates, the conducting state becomes unstable.

FIG. 19 illustrates voltages supplied to the anode 5, in which the vertical axis indicates voltage and the horizontal axis indicates time. The curve 62 indicates a voltage when plating starts, and the curve 64 indicates voltage when the plating has progressed to a certain extent. The plating power supply 105 is a constant current source. A deteriorated contact state between the band and the anode 5 increases the contact resistance between the band and the anode 5. Therefore, the voltage values when the plating has progressed to a certain extent are greater than the voltage values when the plating starts. In addition, the curve 64 includes more noise due to the deteriorated contact state.

The outer peripheral portion of the anode 5 indicates, for example, the following amount of dissolution. In the case of a copper-phosphorus (Cu—P) soluble anode, in which the anode has a thickness of 15 mm when plating starts, and when the plating has progressed, its thickness is reduced to 5 mm, the diameter of the anode 5 may dissolve about 0.5 mm. At this time, the length of the outer periphery of the anode 5 is reduced about 1.57 mm than the length when plating starts. Before the anode 5 dissolves, the band contacts the anode 5. When the outer periphery of the anode 5 is reduced 1.57 mm, the reduced amount causes the band to be loosened by that much. As a result, the contact state between the band and the anode 5 deteriorates, causing unstable power supply as described above.

It has also been found that the electroplating using a soluble anode involves another problem. The joint portion of the band (the end portion of the band) in the outer peripheral portion of the anode 5 is not covered with the band. The uncovered outer peripheral portion of the anode 5 is exposed to the plating solution. The dissolution rate of the exposed portion of the anode 5 is higher than that of the other peripheral portion of the anode 5 covered with the band contacting the anode. It has been newly found that in the case of a copper-phosphorus anode, in which the anode has a thickness of 15 mm when plating starts, and when the plating has progressed to a certain extent, its thickness is reduced to 5 mm, a 2.5 mm indentation occurs in the exposed portion of the anode 5. Such an indentation also causes band loosening, and thus causes unstable power supply to the anode 5.

It has also been found that the electroplating using a soluble anode involves still another problem. When the plating starts, the thickness of the anode 5 substantially coincides with the width in the thickness direction of the band. Therefore, when the plating starts, the center in the thickness direction of the anode 5 coincides with the center in the thickness direction of the band. However, as the plating progresses, the front side of the anode 5 dissolves and disappears, but the back side of the anode 5 does not dissolve. Therefore, the band does not contact the anode 5 on the front side of the anode 5, but contacts the anode 5 on the back side of the anode 5. As the plating progresses, the center in the thickness direction of the anode 5 moves to the back side of the anode 5, but the center in the thickness direction of the band is unchanged. This means that the center in the thickness direction of the dissolved anode is displaced from the center in the thickness direction of the band. Thus, it has also been found that a displaced center causes an unstable contact state between the anode 5 and the band.

SUMMARY OF THE INVENTION

Accordingly, the present invention has been made to solve the above problems occurring in the prior art, and an object of the present invention is to provide a feeder capable of reducing deterioration of the contact state between the feeder and an anode more than the prior art as dissolution of the anode progresses.

The present invention has another object to provide a feeder capable of reducing the dissolution rate of an anode in an end portion of the feeder more than the prior art.

The present invention has still another object to provide a feeder capable of reducing displacement between the center in the thickness direction of the anode and the center in the thickness direction of the feeder more than the prior art as dissolution of the anode progresses.

In order to solve the above problems, a first aspect provides a feeder capable of feeding an anode for use in plating a substrate, the feeder comprising a main body portion which can be disposed on an outer periphery of the anode, and a force applying member which is disposed in the main body portion and can apply a first force to the main body portion in a direction from the main body portion toward a region surrounded by the main body portion.

The present aspect provides a force applying member applying a force to the main body portion in a direction toward a region surrounded by the main body portion, and thus can maintain a good contact state between the feeder and the anode as the anode dissolution progresses. In other words, the present aspect can reduce the deterioration of the contact state between the feeder and the anode more than the prior art.

A second aspect provides a feeder, wherein the force applying member includes an end member disposed in at least one of two end portions of the main body portion in an outer peripheral direction of the region, the end member can apply a second force to the two end portions so as to bring the two end portions close to each other, and by applying the second force to the two end portions, can apply the first force to the main body portion.

A third aspect provides a feeder, wherein the force applying member includes a connecting member connecting at least two portions of the main body portion, and the connecting member is disposed in a direction crossing the region outside the region and can apply the first force to the at least two portions so as to bring the at least two end portions close to each other.

A fourth aspect provides a feeder comprising a conductor which can be disposed on an outer periphery of the anode, wherein the main body portion can be disposed on an outer periphery of the conductor.

A fifth aspect provides a feeder, wherein a width of the main body portion in a thickness direction of the anode is smaller than a thickness of the anode.

A sixth aspect provides a feeder capable of feeding an anode for use in plating a substrate, the feeder comprising a main body portion which can be disposed on an outer periphery of the anode, and a force applying member which is disposed in the main body portion and can apply a first force to the main body portion in a direction from the main body portion toward a region surrounded by the main body portion, wherein the force applying member includes a connecting member connecting at least two portions of the main body portion, and the connecting member is disposed in a direction crossing the region outside the region and can apply the first force to the at least two portions so as to bring the at least two end portions close to each other.

A seventh aspect provides a feeder capable of feeding an anode for use in plating a substrate, the feeder comprising a conductor which can be disposed on an outer periphery of the anode, and a main body portion which can be disposed on an outer periphery of the conductor.

In the present aspect, the conductor is disposed on an outer periphery of the anode and the main body portion is disposed on an outer periphery of the conductor. More specifically, the conductor is interposed between the anode and the main body portion, and in the end portion of the main body portion, the anode is covered with the conductor. In the end portion of the main body portion, the anode is not exposed to the plating solution, and thus the anode has no exposed portion. For this reason, the dissolution rate of the anode is the same as that in the end portion and the other portions of the main body portion. In other words, the present aspect can reduce the dissolution rate of the anode in the end portion of the main body portion more than the prior art.

The conductor material is preferably a material whose ionization tendency is smaller than that of the anode material or a material which forms a passive film and does not dissolve in the plating solution. Of the materials whose ionization tendency is smaller than that of the anode material, the material which does not form a passive film may form a local cell between the material and the anode and may dissolve the anode. Accordingly, of the materials whose ionization tendency is smaller than that of the anode material, the material which forms a passive film is more preferable than the material which does not form a passive film. Thus, the preferable conductor material is a material which forms a passive film and does not dissolve in the plating solution.

An eighth aspect provides a feeder capable of feeding an anode for use in plating a substrate, the feeder comprising a main body portion which can be disposed on an outer periphery of the anode, wherein a width of the main body portion in a thickness direction of the anode is smaller than a thickness of the anode.

In the present aspect, when the plating starts, the width of the main body portion in a thickness direction of the anode is smaller than the thickness of the anode. When the plating starts, the main body portion is attached as closely as possible to the back side of the anode, whereby the center in the thickness direction of the main body portion can be disposed closer to the back side of the anode than the center in the thickness direction of the anode. As the plating progresses, the front side of the anode dissolves and disappears, but the back side of the anode dissolves extremely less than the front side of the anode. When the plating starts, the width of the main body portion in a thickness direction of the anode is smaller than the thickness of the anode. Thus, even after the plating starts, the main body portion has a larger width contacting the anode than that of the prior art. As the plating progresses, the front side of the anode dissolves, and the center in the thickness direction of the anode moves to the back side of the anode and approaches the center in the thickness direction of the main body portion. Since the center in the thickness direction of the anode approaches, the present aspect can reduce the displacement between the center in the thickness direction of the anode and the center in the thickness direction of the main body portion more than the prior art. Further, the present aspect can reduce an unstable contact state between the anode and the main body portion more than the prior art.

A ninth aspect provides a feeder comprising a force applying member which can apply a force to the main body portion in a direction from the main body portion toward a region surrounded by the main body portion, in the seventh and eighth aspects.

A tenth aspect provides a feeder, wherein the anode is a soluble anode.

An eleventh aspect provides a plating apparatus comprising a plating tank capable of containing a plating solution, a feeder according to any one of claims 1 to 10, wherein the anode can be disposed, a substrate holder capable of holding the substrate, and a plating power supply capable of passing a current between the feeder and the substrate, wherein the substrate can be plated by immersing the substrate holder in the plating solution.

BRIEF DESCRIPTION OF THE DRAWINGS

FIG. 13A is a plan view;

FIG. 13B is a sectional view along line A-A of FIG. 13A;

FIG. 14A is a plan view;

FIG. 14B is a sectional view along line A-A of FIG. 14A;

FIG. 20A is a plan view thereof;

FIG. 20B is a sectional view along line A-A of FIG. 20A.

DETAILED DESCRIPTION OF THE PREFERRED EMBODIMENTS

Figure 1:
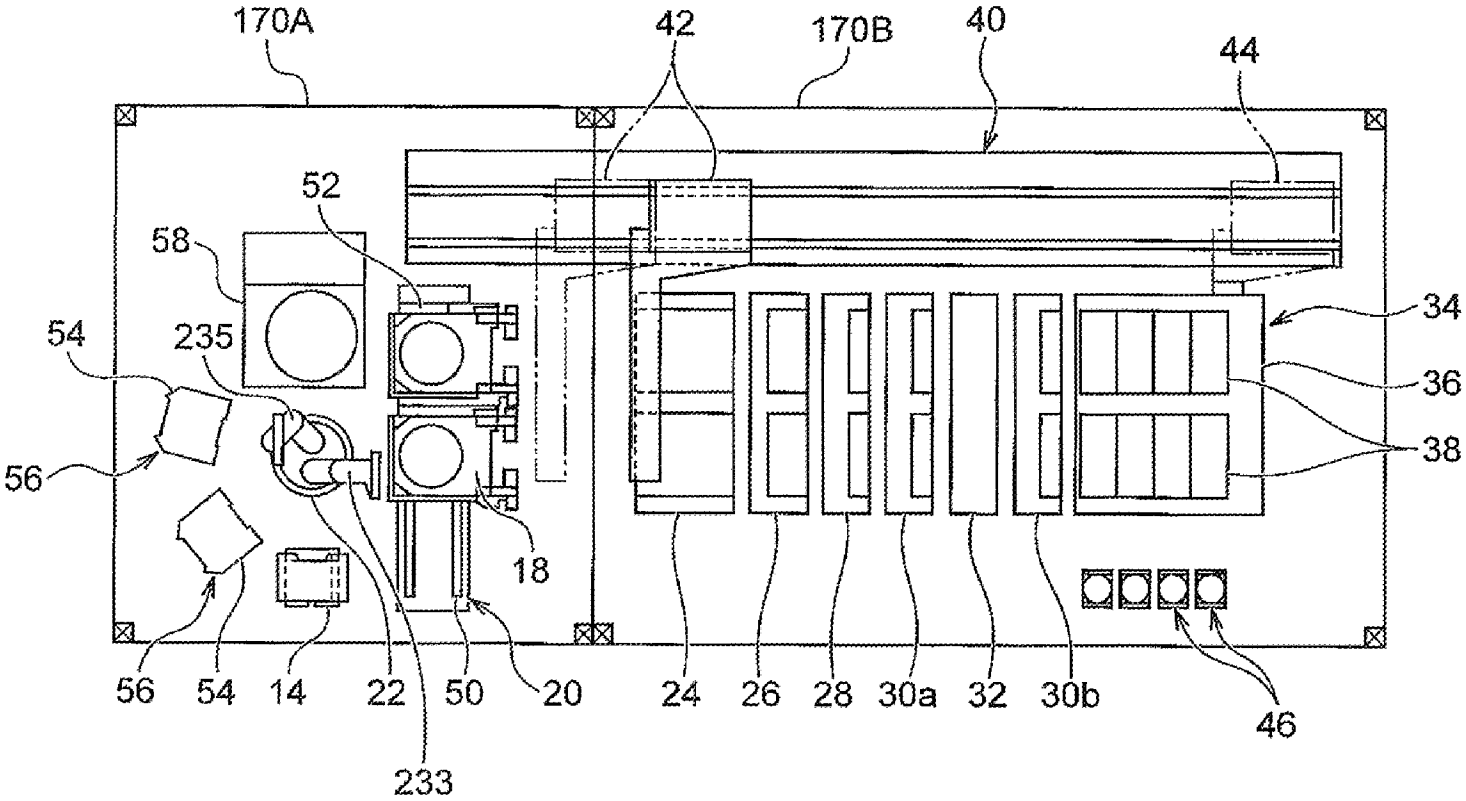
FIG. 1 is an overall layout view of a plating apparatus having a band portion according to an embodiment of the present invention.

Hereinafter, embodiments of the present invention will be described with reference to the accompanying drawings. In each of the following embodiments, the same reference numerals or characters are assigned to the same or similar members, and the duplicate description is omitted.

FIG. 1 is an overall layout view of a plating apparatus having a feeding band (feeder) according to an embodiment of the present invention. In the present embodiment, the plating apparatus performing plating on a substrate is, for example, a bump plating apparatus forming a bump on the surface of a semiconductor substrate. Alternatively, the plating apparatus may be a plating apparatus performing plating on a deep via hole which is provided in the substrate and has a diameter of 10 to 20 μm, a depth of about 70 to 150 μm, and a high aspect ratio. The plating apparatus of the present embodiment is roughly divided into a loading/unloading section 170A which loads a substrate into a substrate holder 18 or unloads a substrate from the substrate holder 18; and a treatment section 170B which treats the substrate.

As illustrated in FIG. 1, the loading/unloading section 170A includes a cassette table 56, an aligner 14, and a spin dryer 58. The two cassette tables 56 are used to mount a cassette 54 thereon containing a substrate WF such as a semiconductor wafer. The aligner 14 aligns the positions of an orientation flat, a notch, and the like of the substrate WF in a predetermined direction. The spin dryer 58 dries the substrate WF by rotating the substrate WF at high speed after the plating process. The loading/unloading section 170A also includes a substrate attaching/detaching section 20 which is provided near the aligner 14 and the spin dryer 58 and places the substrate holder 18 thereon to attach and detach the substrate WF to and from the substrate holder 18. The loading/unloading section 170A further includes a substrate transport device 22 which is disposed at the center of the cassette table 56, the aligner 14, the spin dryer 58, and the substrate attaching/detaching section 20, and includes transporting robots for transporting substrates WF among these devices.

The treatment section 170B includes a stocker (wagon) 24 for storing and temporarily placing the substrate holder 18, a pre-wet tank 26 for immersing the substrate WF in pure water, a pre-soak tank 28 for removing by etching an oxide film on the surface of a seed layer or the like formed on the surface of the substrate WF, a first washing tank 30*a* for washing the surface of the substrate WF with pure water, a blow tank 32 for draining the substrate WF after washing, a second washing tank 30*b*, and a plating tank 34, which are arranged sequentially in this order from the substrate attaching/detaching section 20. The plating tank 34 includes a plurality of plating units 38 contained in an overflow tank 36. Each plating unit 38 includes one substrate holder 18 therein on which copper plating or the like is performed.

Further, the treatment section 170B includes a substrate holder transport unit 40 which uses, for example, a linear motor system and is located on a side of each of these devices to transport the substrate holder 18 together with the substrate WF to and from each of these devices. The substrate holder transport unit 40 includes a first transporter 42 and a second transporter 44. The first transporter 42 transports the substrate WF between the substrate attaching/detaching section 20 and the stocker 24. The second transporter 44 transports the substrate WF among the stocker 24, the pre-wet tank 26, the pre-soak tank 28, the washing tanks 30*a* and 30*b*, the blow tank 32, and the plating tank 34.

The treatment section 170B also includes a paddle drive device 46 which is disposed opposite to the substrate holder transport unit 40 with the overflow tank 36 therebetween. The paddle drive device 46 drives a paddle (unillustrated) which is located in each plating unit 38 and serves as a stirring bar for agitating the plating solution.

The substrate attaching/detaching section 20 includes two flat plate shaped placement plates 52 slidable along the rail 50. Each placement plate 52 has one substrate holder 18 thereon and a total of two substrate holders 18 are placed in parallel on the placement plates 52. The substrate WF is transferred between one substrate holder 18 of the two substrate holders 18 and the substrate transport device 22. Then, the placement plate 52 laterally slides, and the substrate WF is transferred between the other substrate holder 18 and the substrate transport device 22.

The placement plate 52 can move 90° to a vertical position and a horizontal position around a rotating shaft (unillustrated). The placement plate 52 is vertically rotated and then transfers the substrate holder 18 to the substrate holder transport unit 40.

When the plating process is performed on a substrate, the substrate holder 18 holds the substrate by sealing the end portion and the back surface of the substrate from the plating solution and exposing a to-be-plated surface of the substrate. Note that the substrate holder 18 may include a contact which contacts a peripheral edge portion of the to-be-plated surface of the substrate to receive power from an external power supply (plating power supply). Before the plating process, the substrate holder 18 is stored in the stocker 24. When the plating process starts, the substrate holder 18 is moved between the substrate transport device 22 and the plating treatment section by the substrate holder transport unit 40. After the plating process completes, the substrate holder 18 is stored in the wagon again. In the plating apparatus, the substrate held by the substrate holder 18 is vertically immersed in the plating solution of the plating tank 34, and then plating is performed while the plating solution is injected from the bottom of the plating tank 34 and overflows. As described above, the plating tank 34 preferably includes a plurality of plating units 38. In each plating unit 38, one substrate holder 18 holding one substrate is vertically immersed in the plating solution to be plated. Each plating unit 38 preferably includes an insertion portion of the substrate holder 18, a conducting portion to the substrate holder 18, an anode, a paddle stirrer, and a shielding plate. The anode is used by being held by an anode holder and the exposed surface of the anode facing the substrate is concentric with the substrate. The substrate held by the substrate holder 18 is treated with a processing fluid in each treatment tank in the plating treatment section.

For example, in the case of a plating apparatus using two plating solutions, each treatment tank may be arranged in the plating treatment section in the order of process such as a pre-washing tank, a pre-treatment tank, a rinse tank, a first plating tank, a rinse tank, a second plating tank, a rinse tank, and a blow tank, or may be arranged in another order. Each treatment tank is preferably arranged in the order of process to eliminate an extra transport path. The type of tanks, the number of tanks, and the arrangement of the tanks in the treatment section can be freely selected according to the treatment purpose of the substrate.

The first transporter 42 and the second transporter 44 of the substrate holder transport unit 40 include an arm suspending the substrate holder, and the arm includes a lifter for holding the substrate holder 18 in a vertical orientation. The substrate holder transport unit can move along a traveling shaft between the substrate attaching/detaching section 20 and the plating treatment section by a transport mechanism (unillustrated) such as a linear motor. The substrate holder transport unit 40 holds and transports the substrate holder 18 in a vertical orientation. The stocker storing the substrate holder can store a plurality of substrate holders 18 in a vertical state.

Here, the type of the plating solution is not particularly limited, but various plating solutions may be used depending on the application. For example, a plating solution for a through-silicon via (TSV) (Si through electrode) plating process may be used.

In addition, there may be used a plating solution containing cobalt-tungsten-boron (CoWB), cobalt-tungsten-phosphide (CoWP), and other compounds for use in forming a metal film on the substrate surface having a Cu wiring. Further, there may be used a plating solution containing, for example, CoWB or Ta (tantalum) compounds for use in forming a barrier film provided on the substrate surface or the surface of concave portions of the substrate before the Cu wiring is formed in order to prevent Cu from diffusing into an insulating film thereof.

The thus configured plating apparatus includes a controller (unillustrated) configured to control each of the aforementioned sections. The controller illustrates a memory (unillustrated) storing predetermined programs, a central processing unit (CPU) (unillustrated) executing the programs stored in the memory, and a control unit (unillustrated) implemented when the CPU executes the programs. The control unit can perform, for example, a transport control of the substrate transport device 22, a transport control of the substrate holder transport unit 40, a control of the plating current and the plating time in the plating tank 34, and other controls. In addition, the controller is configured to communicate with an unillustrated higher-level controller controlling the plating apparatus and other related devices and can exchange data to and from a database of the higher-level controller. Herein, a storage medium constituting the memory stores various setting data and various programs such as a plating process program to be described later. The storage medium may include a memory such as a computer-readable ROM and RAM, and a known disk-shaped storage medium such as a hard disk, a CD-ROM, a DVD-ROM, and a flexible disk.

Figure 2:
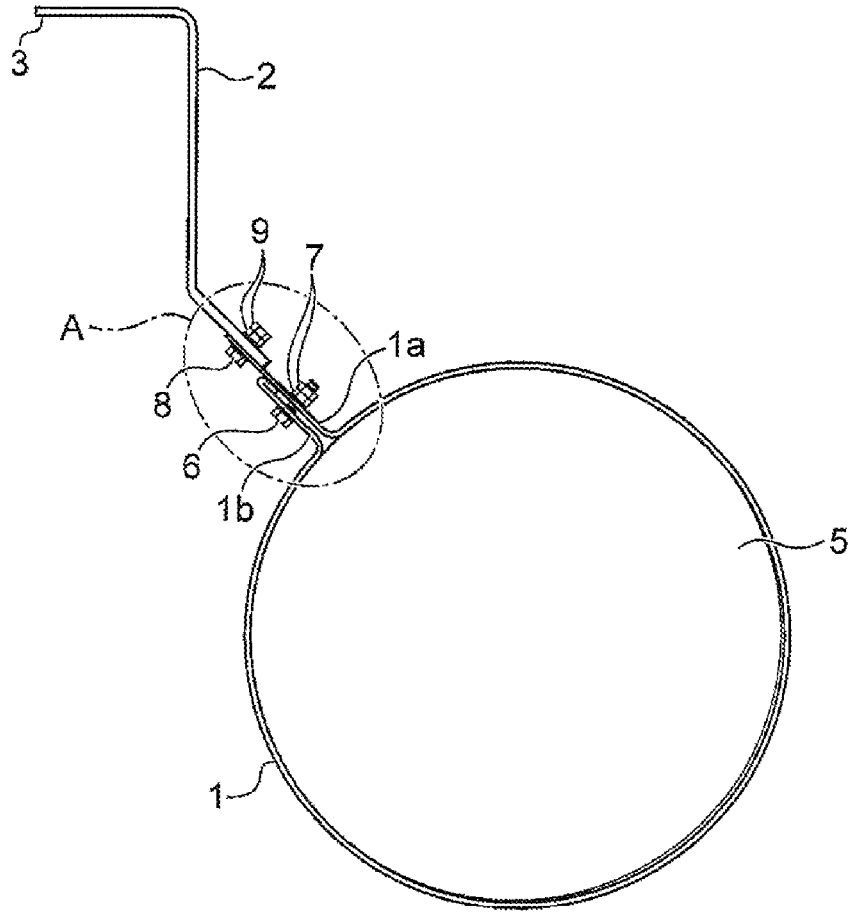
FIG. 2 is a front view of a feeding band holding an anode.
Figure 3:
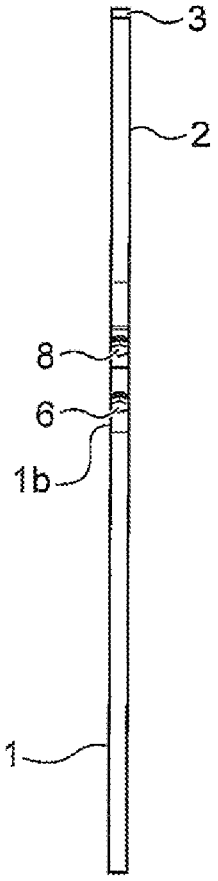
FIG. 3 is a side view of the feeding band.

Now, the description will focus on the detail of the feeding band (feeder). Before the feeding band according to an embodiment of the present invention is described, a feeding band as a comparative example will be described. The feeding band of the comparative example does not include a force applying member which can apply a force to the main body portion in a direction toward a region surrounded by the main body portion of the feeding band. FIGS. 2 to 9 illustrate the feeding band of the comparative example. FIG. 2 is a front view of the feeding band holding an anode. FIG. 3 is a side view of the feeding band.

As illustrated in FIGS. 2 and 3, a main body portion 1 is a belt-like circular thin plate made of a conductive material such as titanium. A disc-shaped anode 5 is fitted inside the main body portion 1. Both end portions 1*a* and 1*b* of the main body portion are tightened by a bolt 6 and a nut 7 to fix the anode 5 thereto. As an example, the main body portion 1 has a thickness of 1 mm to 3 mm and a width of 1 cm to 2 cm. The substrate WF to be plated has a disc shape and thus the anode 5 has the same disc shape as that of the substrate. The anode 5 has a disc shape with an external diameter of 150 mm to 300 mm, and a thickness of 1 cm to 2 cm. Note that in the embodiment of the present invention, the shape of the substrate WF is not limited to a disc shape, but may be a polygon such as a triangle or the like.

Figure 4:
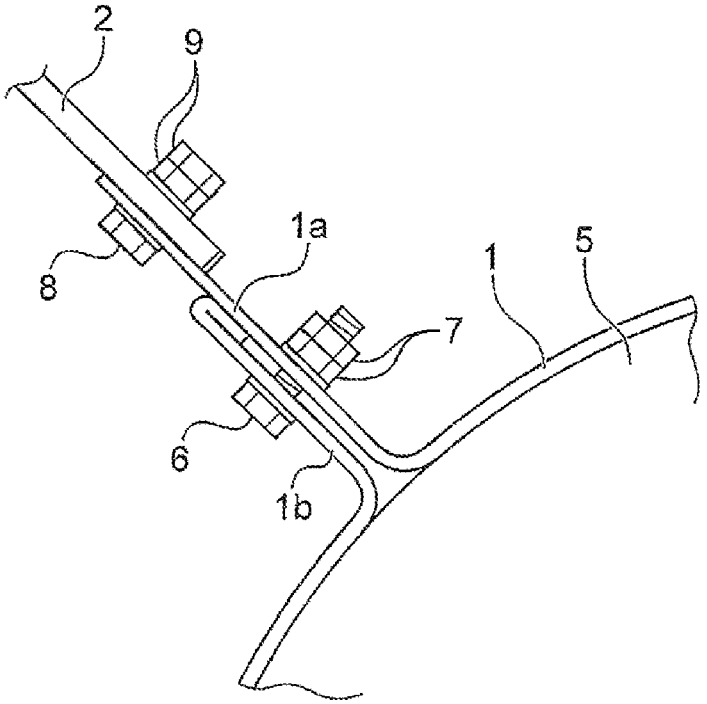
FIG. 4 is a view illustrating a detailed fastening portion which is an enlarged view of a portion indicated by A in FIG. 2.

FIG. 4 is a view illustrating a detailed fastening portion which is an enlarged view of a portion indicated by A in FIG. 2. As illustrated in FIG. 4, the bolt 6 is inserted into both end portions 1*a* and 1*b* of the main body portion 1 and a double nut 7 is screwed to the bolt 6, whereby the anode 5 is tightened and fixed by the main body portion 1. Thus, the entire periphery or substantially the entire periphery of the peripheral edge portion of the disc-shaped anode 5 tightly contacts with the inner peripheral surface of the main body portion 1.

As illustrated in FIGS. 2 and 4, a conductive bracket 2 is fixed to one end portion 1*a* of the main body portion 1 by a bolt 8 and a double nut 9, and a contact portion 3 is provided at a front end portion of the conductive bracket 2. When the contact portion 3 contacts a contact portion (unillustrated) attached to the plating tank, power is supplied to the contact portion.

Figure 5:
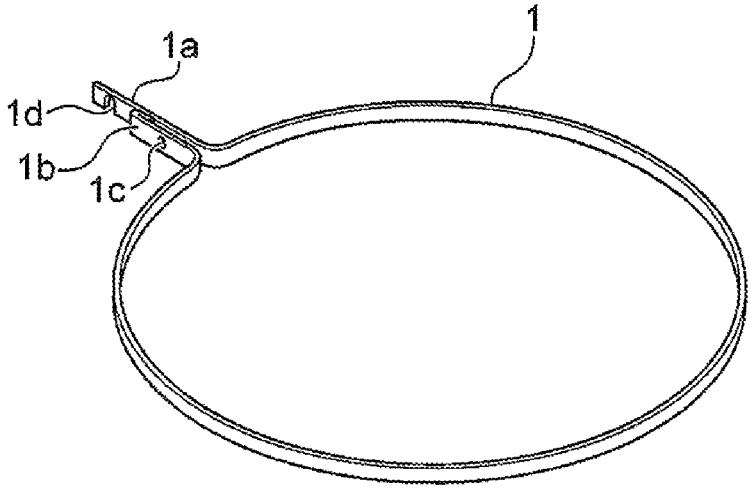
FIG. 5 is a perspective view illustrating the feeding band.

FIG. 5 is a perspective view illustrating the main body portion 1. As illustrated in FIG. 5, a narrow band shaped thin plate is bent into a circular shape and both end portions 1*a* and 1*b* thereof are bent about 90° to form the main body portion 1. In addition, a bolt insertion hole 1*c* for inserting the bolt 6 is formed in both end portions 1*a* and 1*b* of the main body portion 1. Note that one end portion 1*a* of the main body portion is longer than the other end portion 1*b* thereof, and a notch 1*d* for inserting the bolt 8 is formed in the longer end portion 1*a*.

Figure 6:
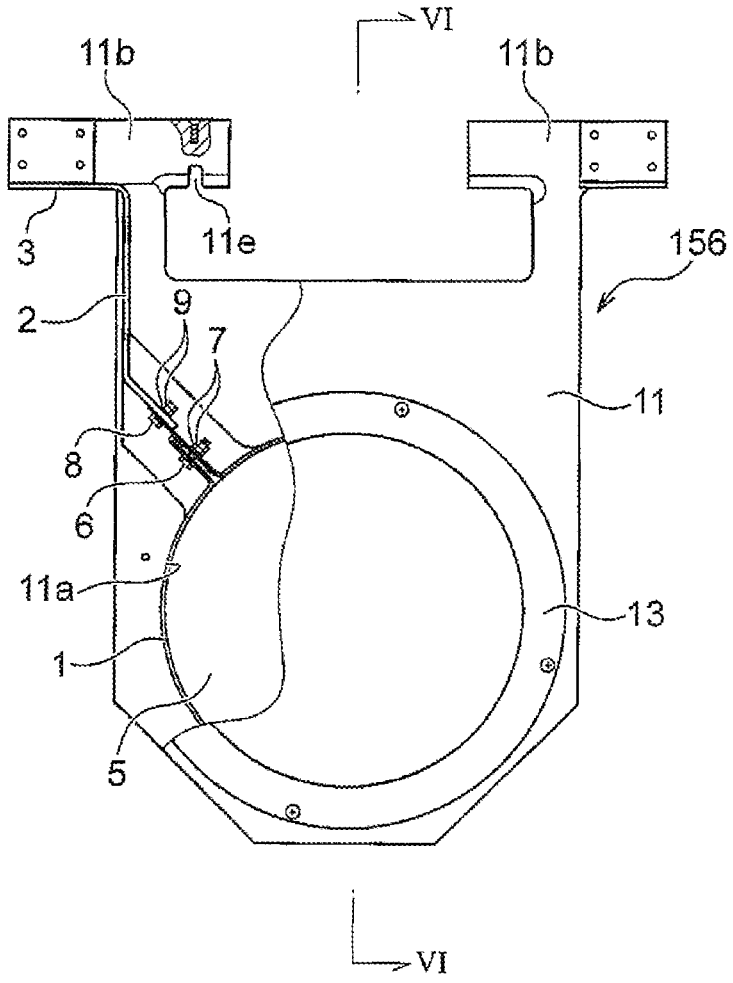
FIG. 6 is a partial cross-sectional front view illustrating an entire configuration of an anode holder.
Figure 7:
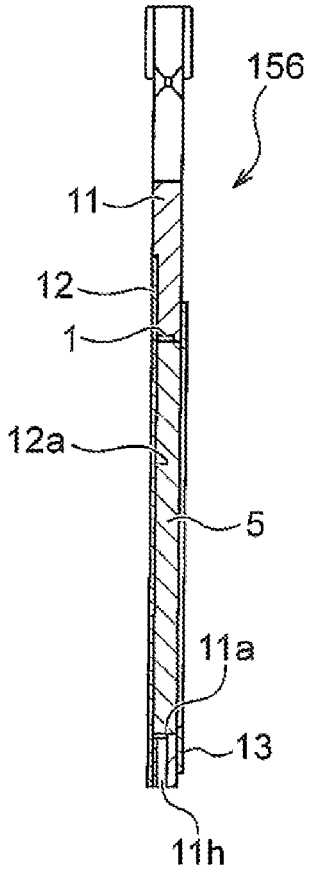
FIG. 7 is a sectional view along line VI-VI in FIG. 6.
Figure 8:
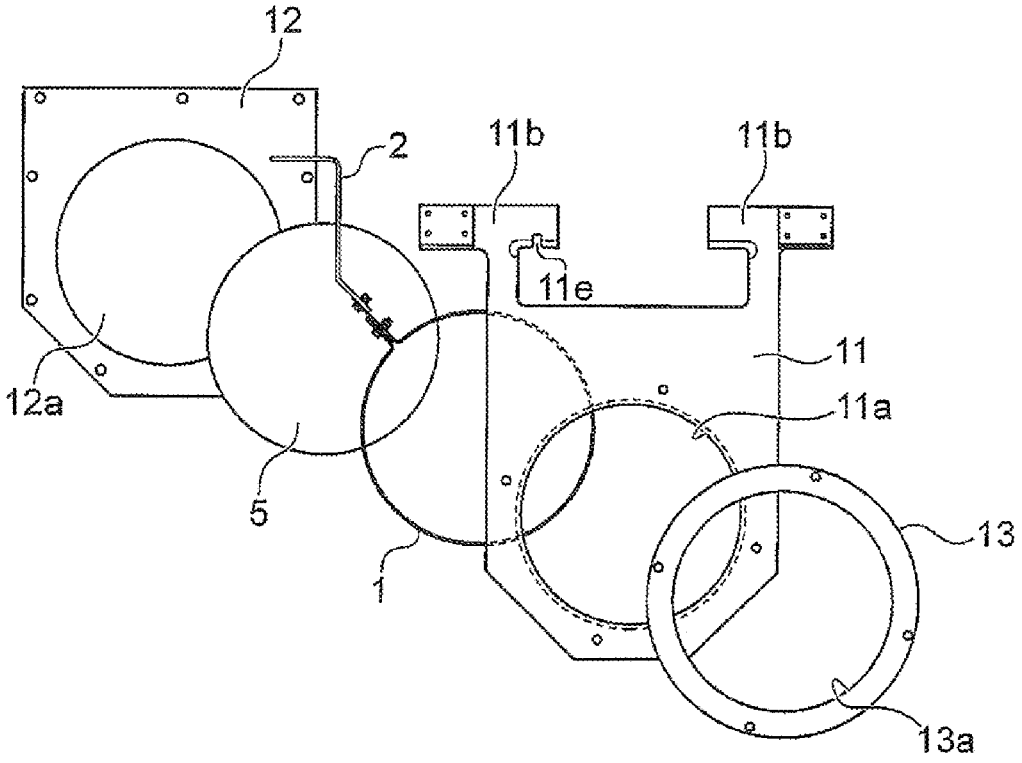
FIG. 8 is an exploded perspective view of the anode holder.

Then, an anode holder 156 holding the anode 5 and the main body portion 1 illustrated in FIGS. 2 to 5 will be described with reference to FIGS. 6 to 8. FIG. 6 is a partial cross-sectional front view illustrating the entire configuration of the anode holder. FIG. 7 is a sectional view along line VI-VI in FIG. 6. FIG. 8 is an exploded perspective view of the anode holder.

As illustrated in FIGS. 6 and 7, the anode holder 156 includes an anode holder base 11, a back cover 12, and an anode mask 13. The anode holder base 11 is used to attach the anode 5 held by the main body portion 1. The back cover 12 is disposed on the back side of the anode holder base 11 to press the back side of the anode 5. The anode mask 13 is disposed on the front side of the anode holder base 11 to cover a part of the front side of the anode 5.

As illustrated in FIG. 8, the anode holder base 11 is a substantially rectangular thin plate, whose center portion includes a circular accommodation hole 11*a* for accommodating the anode 5 held by the main body portion 1. The upper ends of the anode holder base 11 include a pair of substantially T-shaped hands 11*b* and 11*b* so that anodes can be transported by a robot to replace consumed anodes. As illustrated in FIG. 6, a lower portion of the hand 11*b* holds the contact portion 3 of the front end portion of a conductive bracket 2 connected to the main body portion 1. Further, the lower portion of the anode holder base 11 includes a plating solution draining hole 11*h* so as to ensure good drainage when lifted from the plating tank for anode replacement as illustrated in FIG. 7.

As illustrated in FIG. 8, the back cover 12 is a substantially rectangular thin plate whose center portion includes a circular pressing portion 12*a*. As illustrated in FIG. 7, the circular pressing portion 12*a* is slightly thicker than the peripheral portion thereof and is guided into the accommodation hole 11*a*. The pressing portion 12*a* is disposed to press the back surface of the anode 5.

Meanwhile, the anode mask 13 attached to the anode holder base 11 is an annular plate-like part whose center portion includes an opening 13*a*. The inner diameter of the opening 13*a* of the anode mask 13 is smaller than the outer diameter of the anode 5. The anode mask 13 covers (masks) the outer peripheral portion of the anode 5. The electric field on the surface of the anode 5 can be controlled by an opening diameter of the anode mask 13. The anode mask 13 is made of a material such as vinyl chloride, PEEK (polyether ether ketone), and PVDF (polyvinylidene fluoride).

Figure 9:
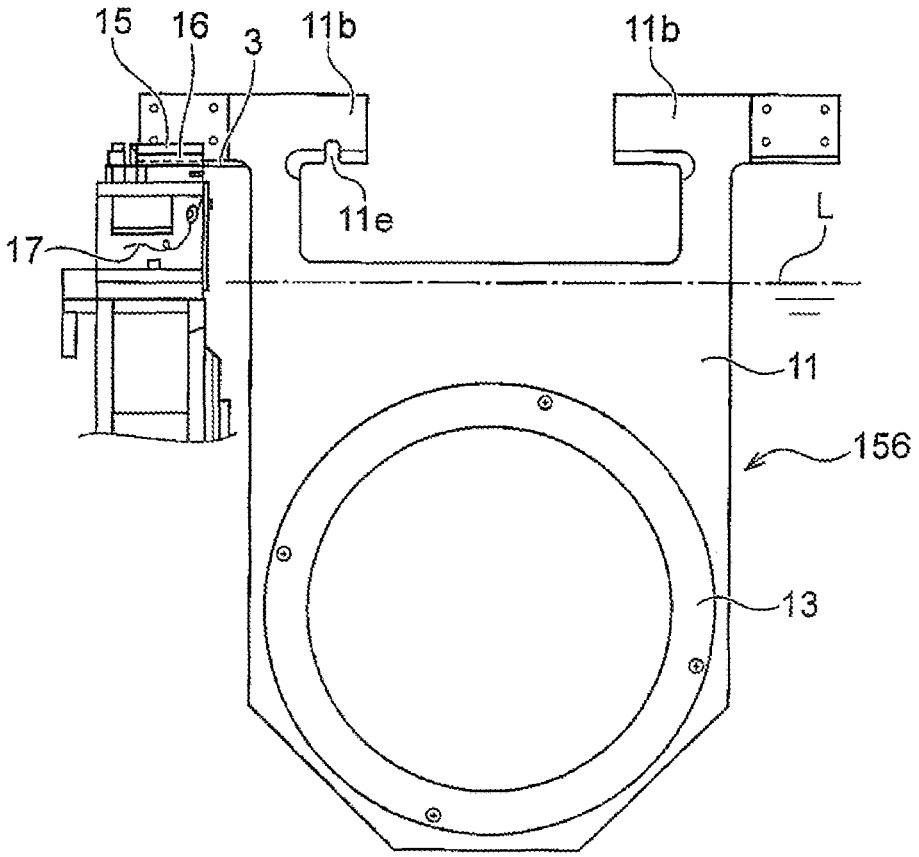
FIG. 9 is a view illustrating a state in which the anode holder is immersed in the plating solution.

FIG. 9 is a view illustrating a state in which the anode holder 156 is immersed in the plating solution. As illustrated in FIG. 9, the anode holder 156 is disposed such that a pair of substantially T-shaped hands 11*b* and 11*b* is positioned slightly above an upper surface L of the plating solution. Power is supplied when the contact portion 3 held by one hand 11*b* of the anode holder 156 contacts a contact plate 16 fixed to a holder 15 provided in a plating tank. Note that the contact plate 16 is connected to a plating power supply (unillustrated) via a power supply wiring 17.

A temporary storage space (unillustrated) is disposed between the washing tank 30 and the plating tank 34 to replace and temporarily place the anode holder 156.

Meanwhile, as described above, the upper portion of the anode holder 156 includes a pair of substantially T-shaped hands 11*b* serving as a support portion for transporting or suspending and supporting the anode holder 156 (see FIGS. 6 and 9). In the temporary storage space, the anode holder 156 can be vertically hung and held by hooking the hand 11*b* to the upper surface of the peripheral wall of the temporary storage space. The anode holder 156 is transported by gripping the hand 11*b* of the hung and held anode holder 156 by the substrate holder transport unit 40. Note that in the pre-wet tank 26, the pre-soak tank 28, the washing tank 30, the blow tanks 32, and the plating tank 34, the anode holder 156 is hung and held on the peripheral wall of these devices via the hand 11*b*.

Figure 10A:
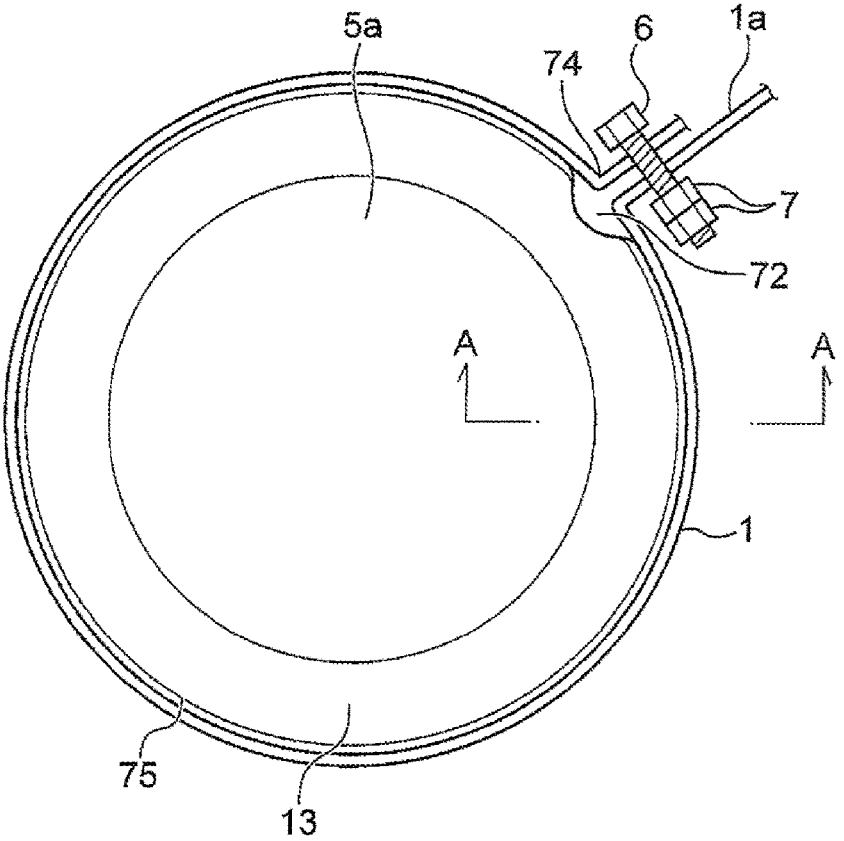
FIG. 10A is a plan view of a main body portion 1 holding an anode 5.
Figure 10B:
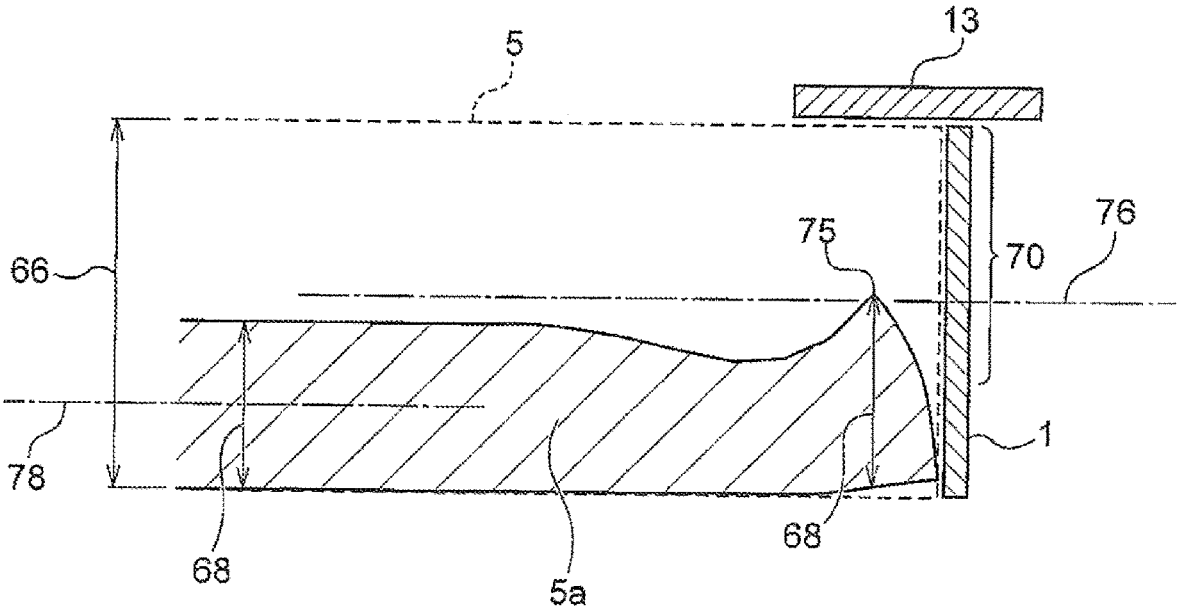
FIG. 10B is a sectional view along line A-A of FIG. 10A.

Now, the description will focus on the problems with the feeding band of the comparative example with reference to FIGS. 10A and 10B. FIG. 10A is a plan view of the main body portion 1 holding the anode 5. FIG. 10B is an enlarged sectional view along line A-A of FIG. 10A. In FIG. 10B, the anode 5 indicated by dotted lines represents the anode 5 when the plating starts, and has a thickness 66. An anode 5*a* indicated by solid lines represents the anode 5 when the plating has progressed to a certain extent, and has a thickness 68 of about half the thickness 66. A portion 70 of the main body portion 1 located on the front side of the anode 5 hardly contacts the anode 5 depending on the anode dissolution state, and thus the contact state between the main body portion 1 and the anode 5 is deteriorated (problem A).

On the periphery of the end portions 1*a* and 1*b* of the main body portion 1, the outer peripheral portion of the anode 5 is not covered with the main body portion 1. Not being covered, the outer peripheral portion of the anode 5 is exposed to the plating solution. The dissolution rate of the exposed portion of the anode 5 is greater than that of the other outer peripheral portion 75 of the anode 5 where the main body portion 1 contacts and covers the anode. Thus, an indentation 72 occurs. The contact state between the main body portion 1 and the anode 5 is deteriorated especially in the indentation 72 (problem B).

Meanwhile, when the plating starts, a center 76 in the thickness direction of the anode 5 coincides with a center 76 in the thickness direction of the main body portion 1. As the plating progresses, a center 78 in the thickness direction of the anode 5*a* moves to the back side of the anode 5 relative to the center 76. However, the center 76 in the thickness direction of the main body portion 1 is unchanged. As a result, the center 78 in the thickness direction of the dissolved anode 5*a* is displaced from the center 76 in the thickness direction of the main body portion 1. If the centers are displaced, the anode 5 is unstably tightened by the main body portion 1, resulting in an unstable contact state between the main body portion 1 and the anode 5 (problem C).

Figure 11A:
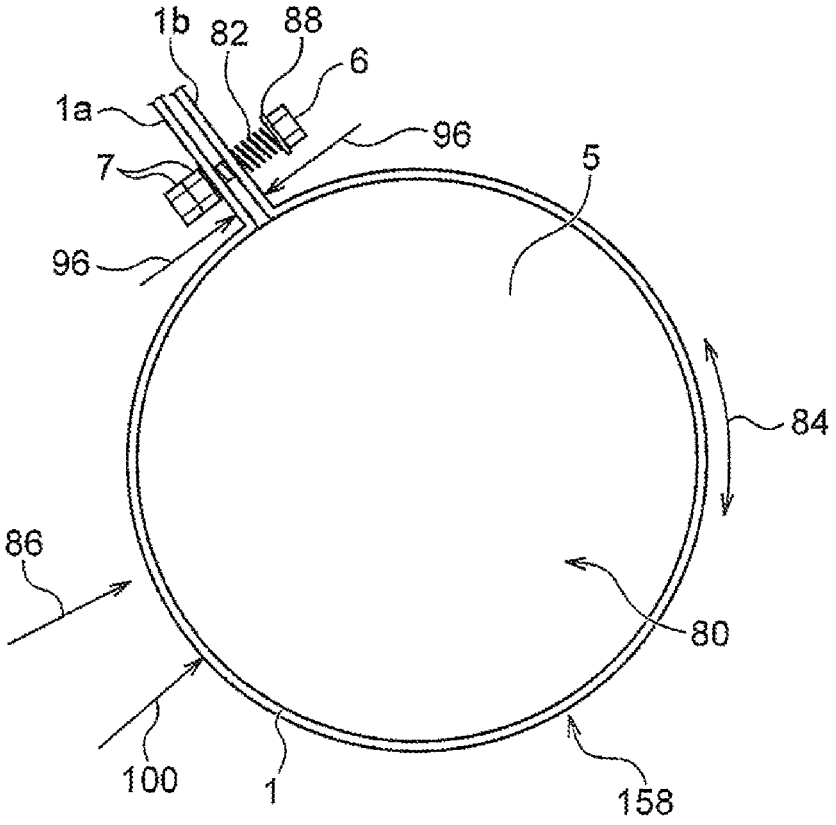
FIG. 11A illustrates a feeder using a spring 82.
Figure 11B:
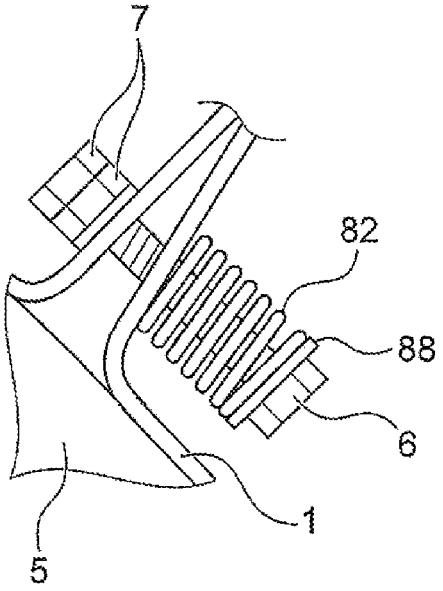
FIG. 11B is an enlarged view of end portions 1*a* and 1*b;*

With reference to FIGS. 11A and 11B, the description will focus on an embodiment of the present invention which can improve the problem A. In the present embodiment, the feeding band 158 includes the main body portion 1 and a force applying member. The force applying member is disposed in the main body portion 1 of the feeding band 158. The force applying member is a spring (end member) 82 which can apply a first force 100 to the main body portion 1 in a direction 86 from the main body portion 1 toward a region 80 surrounded by the main body portion 1. FIG. 11A illustrates a feeder using the spring 82, and FIG. 11B is an enlarged view of end portions 1*a* and 1*b*.

The spring 82 is disposed in the end portion 1*b* of the two end portions 1*a* and 1*b* in the main body portion 1 in an outer periphery direction 84 of the region 80 with a washer 88 therebetween. The spring 82 applies a force (second force) 96 to the two end portions 1*a* and 1*b* so as to bring the two end portions 1*a* and 1*b* close to each other. The first force 100 can be applied to the main body portion 1 by applying the second force 96 to the two end portions. As a result, the spring 82 can apply the first force 100 to the main body portion 1 in the direction 86 from the main body portion 1 toward the region 80 surrounded by the main body portion 1. The magnitude of the force 96 is preferably 40 N or more and 80 N or less. For example, a force 96 of 49 N is applied to each of the two end portions 1*a* and 1*b*.

In the present embodiment, the spring 82 is provided in the end portion 1*b*, but may be provided in the end portion 1*a*. Alternatively, a total of two springs 82 may be provided, one for each of the two end portions 1*a* and 1*b*. Examples of available types of springs include a helical compression spring and a plate spring. Examples of the spring material include titanium alloy, stainless steel, piano wire, Hastelloy, and Inconel.

Figure 12:
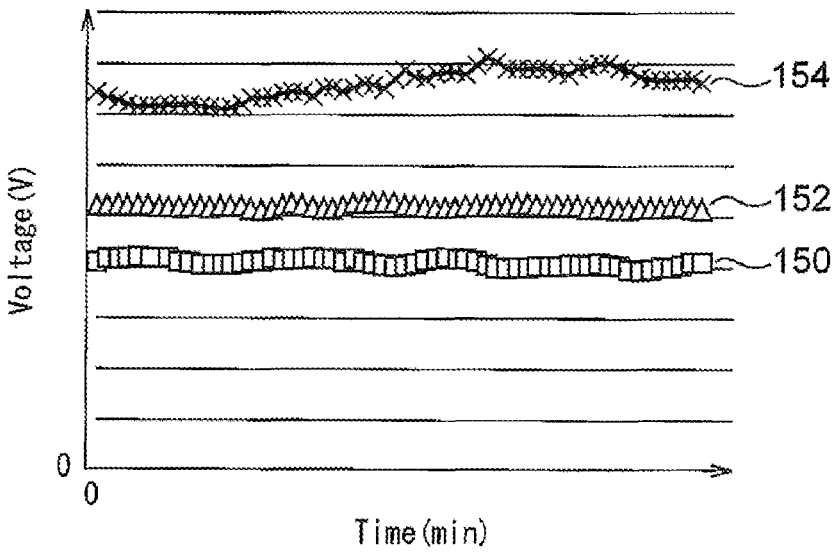
FIG. 12 illustrates a change in the voltage supplied to the anode 5 as the plating progresses.
Figure 19:
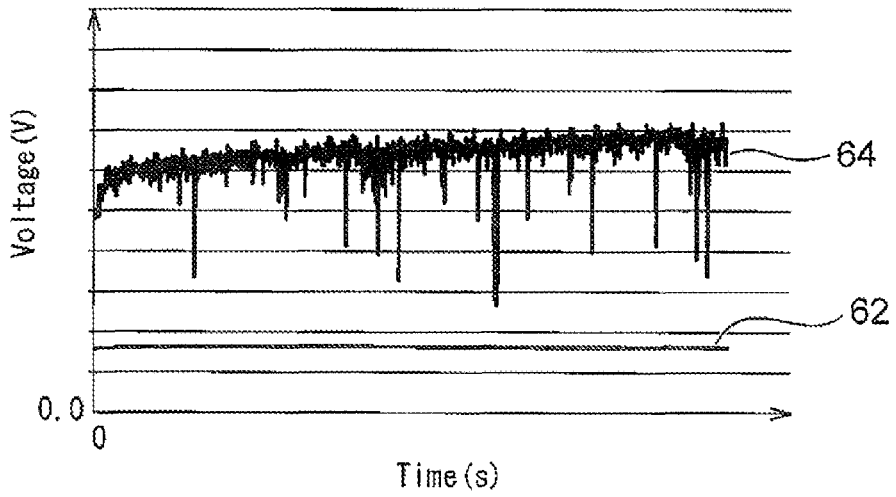
FIG. 19 illustrates voltages supplied to the anode 5.

FIG. 12 illustrates changes in the voltage supplied to the anode 5 of the present embodiment as the plating progresses. FIG. 12 illustrates voltages when a constant current is supplied to the anode 5, in which the vertical axis indicates voltage and the horizontal axis indicates time. A curve 150 represents voltages when 10% of the anode 5 is consumed (that is, the thickness of the anode 5 is reduced by 10%). A curve 152 represents voltages when 50% of the anode 5 is consumed. A curve 154 represents voltages when 85% of the anode 5 is consumed. In comparison with FIG. 19 according to the prior art, the voltage changes by about 0.5 V between the curve 62 and the curve 64 in FIG. 19. In contrast to this, the voltage changes by only about 0.2 V between the curve 150 and the curve 154 in FIG. 12. It can be understood that the present embodiment provides a good contact state since the curve 154 has less noise than the curve 64. It can also be understood from the curve 154 that a good contact state is maintained after 85% or more of the anode 5 dissolves in the thickness direction.

Figure 13A:
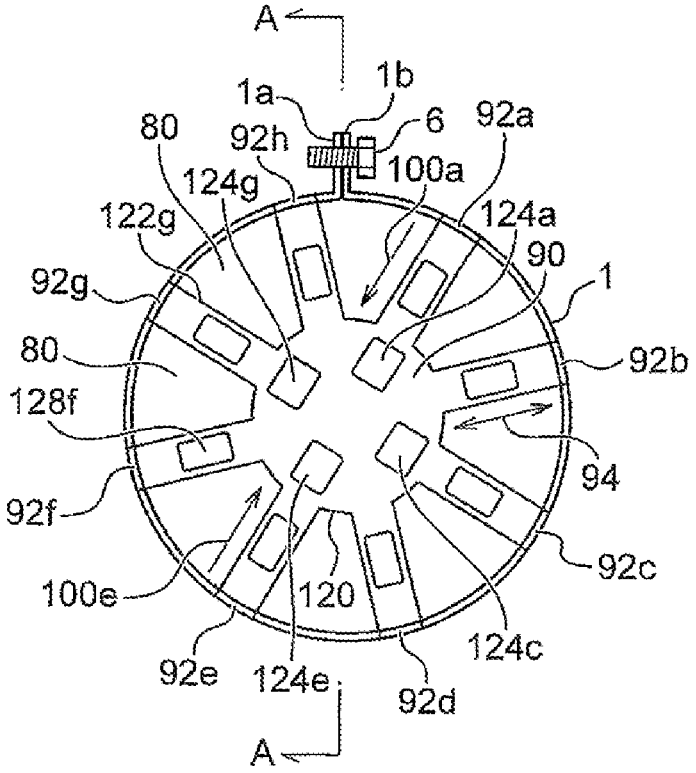
FIG. 13A illustrates a state before a connecting member 90 is attached to the back side of the anode 5.
Figure 13B:
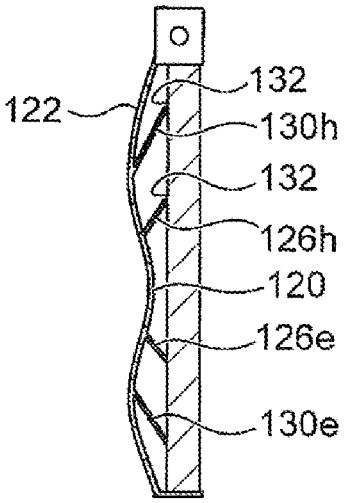
FIG. 13B illustrates a state before a connecting member 90 is attached to the back side of the anode 5.
Figure 14A:
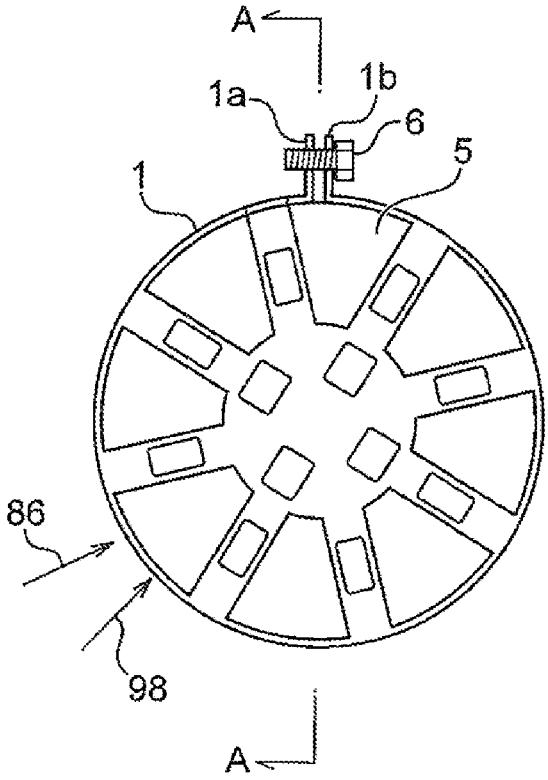
FIG. 14A illustrates a state after the connecting member 90 is attached to the back side of the anode 5.
Figure 14B:
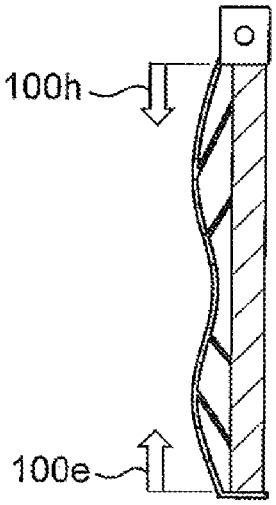
FIG. 14B illustrates a state after the connecting member 90 is attached to the back side of the anode 5.

With reference to FIGS. 13A, 13B, 14A and 14B, the description will focus on another embodiment of the present invention which can improve the problem A. The force applying member of the present embodiment is a connecting member 90 mutually connecting eight portions 92*a* to 92*h* of the main body portion 1. Note that the present invention is not limited to the connecting member 90 mutually connecting the eight portions 92*a* to 92*h*, but may be any connecting member as long as the connecting member 90 mutually connects two or more portions. FIGS. 13A and 13B illustrate a state before the connecting member 90 is attached to the back side of the anode 5. FIG. 13A is a plan view and FIG. 13B is a sectional view along line A-A of FIG. 13A. FIGS. 14A and 14B illustrate a state after the connecting member 90 is attached to the back side of the anode 5. FIG. 14A is a plan view and FIG. 14B is a sectional view along line A-A of FIG. 14A.

The connecting member 90 is disposed in a direction 94 crossing a region 80 outside the region 80 surrounded by the main body portion 1. The connecting member 90 can apply first forces 100*a* to 100*h* so as to bring the eight portions 92*a* to 92*h* close to each other.

This will be described. The connecting member 90 includes a center portion 120 and eight branch portions 122*a* to 122*h* branched from the center portion 120. One of the two end portions of each of the branch portions 122*a* to 122*h* is connected to the center portion 120, and the other is welded to the eight portions 92*a* to 92*h*. FIGS. 13A and 13B illustrate only the branch portion 122*g* with the other reference numerals or characters omitted for clarity of illustration. The center portion 120 includes four hollowed portions 124*a*, 124*c*, 124*e*, and 124*g*, where plate springs 126*a*, 126*c*, 126*e*, and 126*g* are formed by hollowing out. The branch portions 122*a* to 122*h* include the hollowed portions 128*a* to 128*h* respectively, where plate springs 130*a* to 130*h* are formed by hollowing out.

Figure 20A:
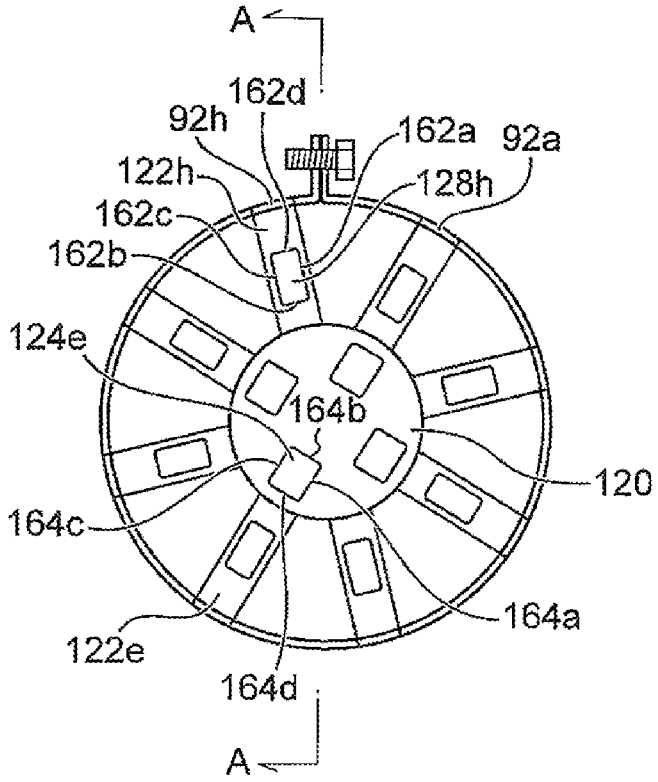
FIG. 20A illustrates a state before the connecting member 90 is attached to the back side of the anode 5.
Figure 20B:
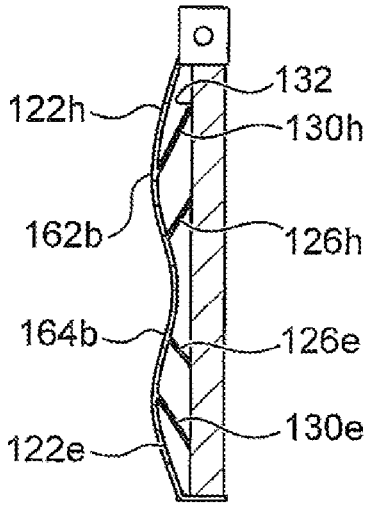
FIG. 20B illustrates a state before the connecting member 90 is attached to the back side of the anode 5.

The description will further move on to how the plate springs 126*a* to 126*g* and the plate springs 130*a* to 130*h* are formed by hollowing out with reference to FIGS. 20A and 20B. FIGS. 20A and 20B are the same as FIGS. 13A and 13B except the filled portions in FIGS. 13A and 13B are removed from FIGS. 20A and 20B. FIG. 20A is a plan view thereof and FIG. 20B is a sectional view along line A-A of FIG. 20A. The four hollowed portions 124*a*, 124*c*, 124*e*, and 124*g* of the center portion 120 are formed in the same way, and thus description will focus on a hollowed portion 124*e*. The eight hollowed portions 128*a* to 128*h* of the branch portions 122*a* to 122*h* are also formed in the same way, and thus description will focus on a hollowed portion 128*h*.

The hollowed portion 124*e* of the center portion 120 is cut at three sides 164*a*, 164*c*, and 164*d* of the four sides 164*a*, 164*b*, 164*c*, and 164*d* forming a rectangle. The side 164*b* is not cut but connected to the center portion 120. The cut plate spring 126*e* is bent toward the anode 5. The hollowed portion 128*h* of the branch portion 122*h* is cut at three sides 162*a*, 162*c*, and 162*d* of the four sides 162*a*, 162*b*, 162*c*, and 162*d* forming a rectangle. The side 162*b* is not cut but connected to the branch portion 122*h*. The cut plate spring 130*h* is bent toward the anode 5.

The connecting member connecting the branch portions 122*a* to 122*h* and the center portion 120 has a corrugated cross section as illustrated in FIG. 13B. Therefore, the connecting member can act as a spring and can generate an elastic force. As illustrated in FIG. 13A, in the state before the connecting member is attached to the anode 5, the inner diameter of the main body portion 1 is smaller than the outer diameter of the anode 5. While the inner diameter of the main body portion 1 is being expanded, the anode 5 is guided into the main body portion 1, and then the main body portion 1 is fixed to the anode 5 by the bolt 6 and the nut 7. When the anode 5 is attached, expanded branch portions 122*a* to 122*h* and center portion 120 generate returning spring forces (first forces) 100*a* to 100*h*.

Note that in the present embodiment, the plate springs 130*a* to 130*h* and the plate springs 126*a*, 126*c*, 126*e*, and 126*g* also contribute to the generation of the first forces 100*a* to 100*e*. This will be described. As illustrated in FIG. 13B, a free end (front end) 132 of the plate spring 126 and the plate spring 130 is bent by the anode 5 when the connecting member 90 is attached to the anode 5.

After the anode 5 is attached, the free end 132 of the plate spring 126 and the plate spring 130 is bent by the back surface of the anode 5 as illustrated in FIGS. 14A and 14B. As a result, the reaction force (spring force) generated by being bent acts in a direction in which the branch portions 122*a* to 122*h* and the center portion 120 are separated from the back surface of the anode 5. When the force in a direction in which the branch portions 122*a* to 122*h* and the center portion 120 are separated from the back surface of the anode 5 is received, the branch portions 122*a* to 122*h* and the center portion 120 generate spring forces (first forces) 100*a* to 100*h*.

The first forces 100*a* to 100*h* are generated by the branch portions 122*a* to 122*h* and the center portion 120 as well as the plate springs 130*a* to 130*h* and the plate springs 126*a*, 126*c*, 126*e*, and 126*g*. Even if the outer diameter of the anode 5 is reduced as the plating progresses, each portion of the main body portion 1 is always pulled in a direction toward the inside of the region 80 so as to have a smaller inner diameter. Since the main body portion 1 is pulled into the region 80, even if the outer diameter of the anode 5 is reduced, a good contact state between the main body portion 1 and the anode 5 can be maintained.

Each magnitude of the first forces 100*a* to 100*h* is preferably 20 N or more, for example, 30 N. Note that a very large value (for example, 1000 N) of the tightening force is not preferable because consumption of a soluble anode as the plating process continues may destroy the soluble anode itself during the plating process.

Figure 15A:
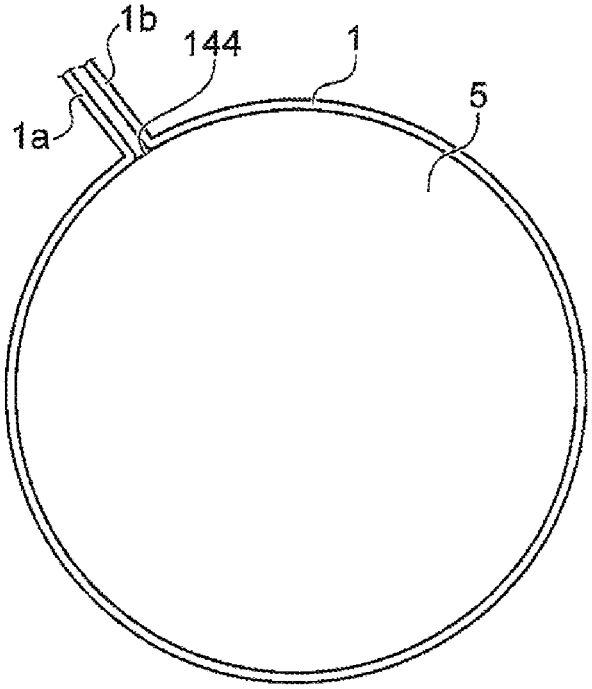
FIG. 15A illustrates a feeder without a conductor 142.
Figure 15B:
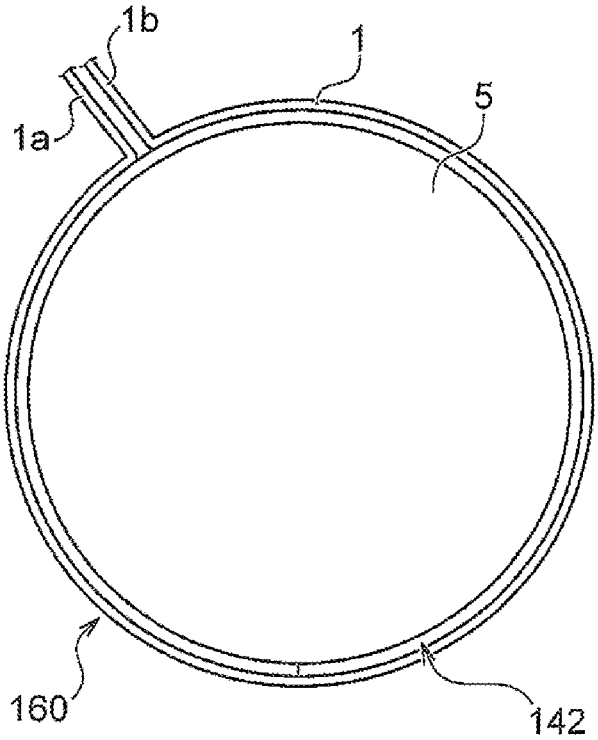
FIG. 15B illustrates a feeder with the conductor 142.

Then, with reference to FIGS. 15A and 15B, the description will focus on another embodiment which can improve the above described problem B. In the present embodiment, the feeder 160 includes a thin conductor 142 which can be disposed on the entire outer periphery of the anode, and a main body portion 1 which can be disposed on the outer periphery of the conductor 142. FIG. 15A illustrates the feeder of a comparative example without the conductor 142, and FIG. 15B illustrates the feeder according to the present embodiment of the present invention with the conductor 142. A thin conductor 142 made of titanium or the like is disposed between the main body portion 1 and the anode 5 to be wound around the entire periphery thereof, thus preventing the side surface of the anode 5 from being directly exposed to the plating solution. Particularly, the side surface 144 of the anode 5 in the end portions 1*a* and 1*b* of the main body portion 1 can be prevented from being exposed to the plating solution.

Figure 16:
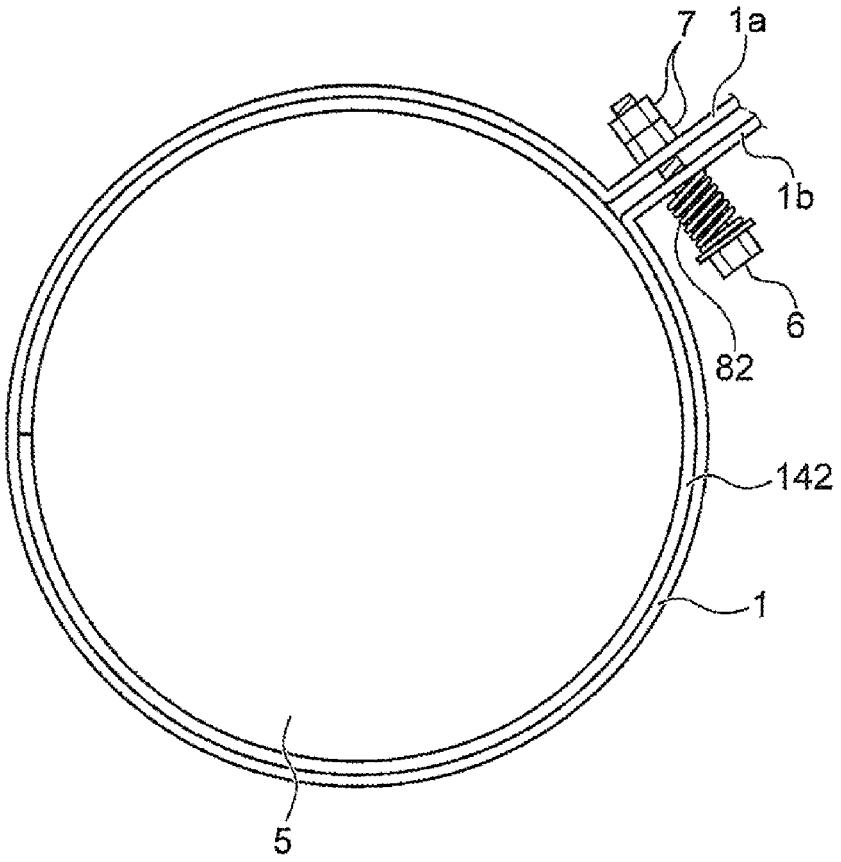
FIG. 16 illustrates an example of adding a thin conductor 142 which can be disposed on an outer periphery of the anode to the embodiment illustrated in FIGS. 11A and 11B.

Note that the thin conductor 142 which can be disposed on the outer periphery of the anode may be added to the embodiment illustrated in FIGS. 11A and 11B. An example thereof is illustrated in FIG. 16.

Figure 17:
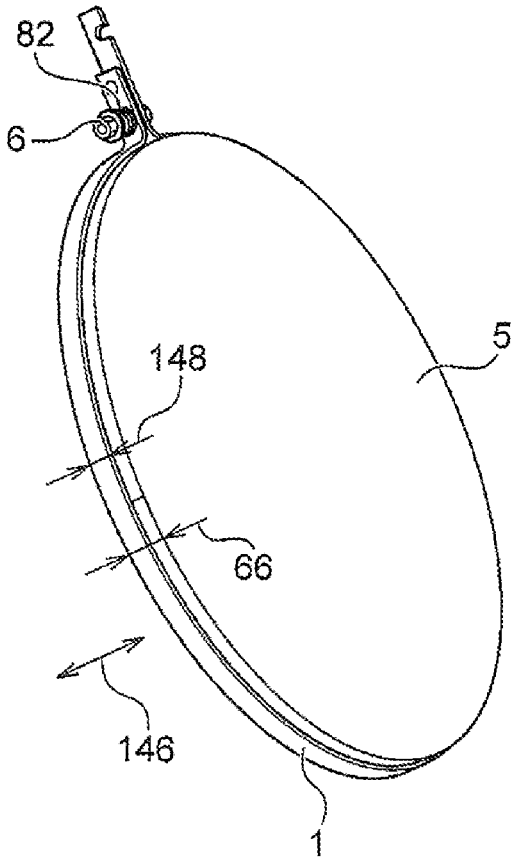
FIG. 17 illustrates another embodiment of the present invention.
Figure 18:
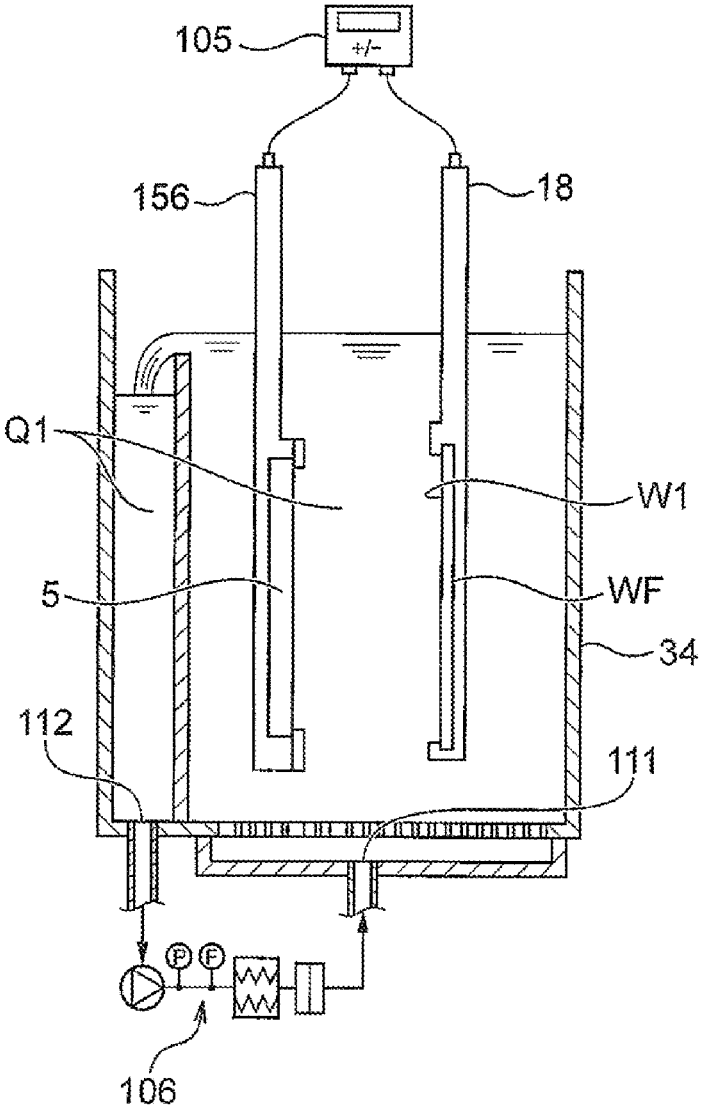
FIG. 18 is a schematic view illustrating a prior art of a so-called vertical immersion plating apparatus in which a substrate and an anode are vertically disposed.

Then, with reference to FIG. 17, the description will focus on another embodiment which can improve the above described problem C. In the present embodiment, the feeding band includes a main body portion 1 which can be disposed on the outer periphery of the anode. The width 148 of the main body portion 1 in a thickness direction 146 of the anode 5 is less than the thickness 66 of the anode 5. In the present embodiment, the width 148 of the main body portion 1 in the thickness direction 146 of the anode 5 is half the thickness 66 of the anode 5.

Before the plating starts, the main body portion 1 is attached as closely as possible to the back side of the anode 5. The center in the thickness direction of the main body portion 1 is disposed closer to the back side of the anode 5 than the center in the thickness direction of the anode 5. In the present embodiment, the main body portion 1 is disposed on only half the back side of the anode 5 of the side surface of the anode 5. A spring 82 is attached to a fastening portion for use in winding the main body portion 1 around the outer periphery of the anode 5. When the diameter of the anode 5 is reduced by dissolution, a spring force is used to reduce the diameter of the main body portion 1.

As the plating progresses, the front side of the anode 5 dissolves and disappears, but the back side of the anode 5 does not dissolve. When the plating starts, the width 148 of the main body portion 1 in the thickness direction 146 of the anode 5 is less than the thickness 66 of the anode 5. Thus, even after the plating starts, the main body portion 1 has a larger width contacting the anode 5 than that of the prior art. As the plating progresses, the front side of the anode 5 dissolves, and the center in the thickness direction 146 of the anode 5 moves to the back side of the anode 5 and approaches the center in the thickness direction of the main body portion 1. Since the center in the thickness direction of the anode 5 approaches, the present embodiment can reduce the displacement between the center in the thickness direction of the anode 5 and the center in the thickness direction of the main body portion 1 more than the prior art. Further, the present embodiment can reduce an unstable contact state between the anode 5 and the main body portion 1 more than the prior art.

Hereinbefore, the examples of the embodiments of the present invention have been described. The embodiments of the invention described above are intended to facilitate understanding of the present invention, but not to limit the present invention. It is readily understood that the present invention can be modified or improved without departing from the spirit thereof, and that the present invention encompasses equivalents thereof. It should be noted that within a range capable of solving at least some of the above described problems or within a range of exerting at least some of the effects, any combination of the components described in the scope of claims and the description can be used or omitted. For example, the present invention may also be applied to a so-called cup-type electroplating apparatus.

This application claims priority under the Paris Convention to Japanese Patent Application No. 2016-116136 filed on Jun. 10, 2016. The entire disclosure of Japanese Patent No. 4,942,580 including specification, claims, drawings and summary is incorporated herein by reference in its entirety.

REFERENCE NUMERALS LIST

1 main body portion
2 conductive bracket
3 contact portion
5 anode
6 bolt
7 double nut
18 substrate holder
1*a* end portion
1*b* end portion
88 washer
90 connecting member
120 center portion
126 plate spring
156 anode holder

What is claimed is:

1. A feeder capable of feeding an anode for use in plating a substrate, the feeder comprising:

a main body portion which is configured to be disposed on substantially an entire periphery of an outer periphery of the anode;

a spring which is disposed in the main body portion and configured to apply a first force to the main body portion in a direction from the main body portion toward a region surrounded by the main body portion; and a fastening portion which is configured to dispose the spring in at least one of two end portions of the main body portion in an outer peripheral direction of the region, wherein the two end portions extend in a direction away from the region, the fastening portion comprises two end portions and a shaft which connects the two end portions of the fastening portion, the shaft passes through the spring and the two end portions of the main body portion, the spring and the two end portions of the main body portion are disposed between the two end portions of the fastening portion, the spring are not disposed between the two end portions of the main body portion, and the spring is configured to apply a second force to the two end portions of the main body portion to bring the two end portions of the main body portion close to each other so as to apply the first force to the main body portion, wherein the feeder comprises a conductor which can be disposed on an outer periphery of the anode, and the conductor is a belt-shaped band, wherein the main body portion can be disposed on substantially an entire periphery of an outer periphery of the conductor.

2. A feeder capable of feeding an anode for use in plating a substrate, the feeder comprising:

a main body portion which is configured to be disposed on an outer periphery of the anode; and a force applying member which is disposed in the main body portion and configured to apply a first force to the main body portion in a first direction to cause a second force toward a region surrounded by the main body portion in radial direction, wherein the force applying member includes a connecting member connecting at least two portions of the main body portion, and the connecting member is configured to extend across a back side of the anode outside the region, and apply the first force to the at least two portions so as to bring the at least two end portions close to each other.

3. A feeder according to claim 1, wherein the anode is a soluble anode.

4. A plating apparatus comprising:

a plating tank capable of containing a plating solution;

a feeder according to claim 1, wherein the anode can be disposed, a substrate holder capable of holding the substrate; and a plating power supply capable of passing a current between the feeder and the substrate, wherein the substrate can be plated by immersing the substrate holder in the plating solution.

* * * * *